US008818246B2

(12) United States Patent
Kouroku

(10) Patent No.: US 8,818,246 B2
(45) Date of Patent: Aug. 26, 2014

(54) TONER REPLENISHING CONTAINER AND IMAGE FORMING APPARATUS DETACHABLY PROVIDED WITH THE SAME

(71) Applicants: Casio Electronics Manufacturing Co., Ltd., Iruma (JP); Casio Computer Co., Ltd., Tokyo (JP)

(72) Inventor: Moriyuki Kouroku, Tokyo (JP)

(73) Assignees: Casio Electronics Manufacturing Co., Ltd., Tokyo (JP); Casio Computer Co., Ltd., Tokyo (JP)

( * ) Notice: Subject to any disclaimer, the term of this patent is extended or adjusted under 35 U.S.C. 154(b) by 44 days.

(21) Appl. No.: 13/748,860

(22) Filed: Jan. 24, 2013

(65) Prior Publication Data

US 2013/0216243 A1 Aug. 22, 2013

(30) Foreign Application Priority Data

Feb. 21, 2012 (JP) ..... 2012-035631

(51) Int. Cl.
*G03G 15/08* (2006.01)
*G03G 15/01* (2006.01)

(52) U.S. Cl.
CPC ..... *G03G 15/0834* (2013.01); *G03G 15/0863* (2013.01); *G03G 15/0867* (2013.01); *G03G 15/0886* (2013.01); *G03G 15/0836* (2013.01); *G03G 15/0189* (2013.01)
USPC ..... 399/258; 399/262

(58) Field of Classification Search
CPC ..... G03G 15/0832; G03G 15/0834; G03G 15/0836; G03G 15/0837; G03G 15/0867; G03G 15/0868; G03G 15/087; G03G 15/0872
USPC ..... 399/12, 258, 262
See application file for complete search history.

(56) References Cited

U.S. PATENT DOCUMENTS

| | | | | |
|---|---|---|---|---|
| 2005/0196180 | A1* | 9/2005 | Harumoto | 399/12 |
| 2010/0209141 | A1* | 8/2010 | Ikado | 399/119 |
| 2012/0321341 | A1* | 12/2012 | Hori et al. | 399/110 |

FOREIGN PATENT DOCUMENTS

| | | | |
|---|---|---|---|
| JP | 09-050174 | A | 2/1997 |
| JP | 2003-084534 | A | 3/2003 |

* cited by examiner

*Primary Examiner* — Clayton E Laballe
*Assistant Examiner* — Ruifeng Pu
(74) *Attorney, Agent, or Firm* — Holtz Holtz Goodman & Chick PC

(57) ABSTRACT

A toner replenishing container includes a storage chamber, a hole and an identification member. The storage chamber stores a toner for replenishment. The hole is engaged with the toner replenishing container identifying portion of the mounting portion when the toner replenishing container is mounted on the mounting portion, is formed at a predetermined position on a front surface of the toner replenishing container in a mounting direction, and has a polygonal cross-section. The identification member is detachably inserted into the hole in a form corresponding to the polygonal shape of the hole when an orientation of the identification member is rotated about a center line of the hole.

18 Claims, 10 Drawing Sheets

TONER REPLENISHING CONTAINER AND IMAGE FORMING APPARATUS DETACHABLY PROVIDED WITH THE SAME

CROSS-REFERENCE TO RELATED APPLICATION

This application claims priority based on Japanese Patent Application No. 2012-035631, filed on Feb. 21, 2012, the entire contents of which are incorporated by reference herein.

FIELD

The present invention relates to a toner replenishing container and an image forming apparatus detachably provided with the toner replenishing container, and more particularly, the toner replenishing container that replenishes the toner to a developing section of an image forming apparatus, which forms a color image, with toner and an image forming apparatus that is detachably provided with the toner replenishing container.

BACKGROUND

In the past, there has been an electrophotographic image forming apparatus. This image forming apparatus is generally initialized by uniformly charging a photoreceptor drum, forms an electrostatic latent image on the photoreceptor drum by optical writing, converts the electrostatic latent image into a toner image, that is, develops the electrostatic latent image, directly or indirectly transfers the toner image onto a transfer medium such as a sheet, and fixes the toner image with a fixing unit.

A developing unit is used to convert the electrostatic latent image into the toner image. The developing unit is provided with a developing roller that supplies toner to a photoreceptor drum, an auger roller that supplies toner to the developing roller while stirring and conveying the toner, and the like.

The toner present in the developing unit is a consumable that is consumed by development. When a sensor, a printed sheet counter, or the like detects that the toner present in the developing unit is equal to or smaller than a predetermined amount, the developing unit is replenished with toner from a toner replenishing container. The toner replenishing container, of which toner is used up and which becomes empty, is replaced with a new toner replenishing container.

Meanwhile, in the image forming apparatus for forming a color image, images are generally formed using, for example, four kinds of colors, that is, black, magenta, cyan, and yellow. For this reason, the image forming apparatus is provided with four kinds of image forming units. The image forming unit generally includes a developing kit and a photoreceptor kit.

In an early image forming unit, the developing kit is replaced with a new developing kit when toner of the developing kit is consumed and is used up. However, it is not easy to replace the developing kit. Accordingly, JP-A-09-50174 proposes a color electrophotographic apparatus in which a toner cartridge for replenishing a developing unit with toner is detachably mounted on the developing unit so that the developing unit can be easily replenished with toner for each color.

Meanwhile, generally, four kinds of toner replenishing containers (toner cartridges) corresponding to the developing kits (developing units) of the four kinds of image forming units have the same appearance and structure except that the colors of the toners stored in the toner replenishing containers are different from each other.

Since the toner replenishing containers have the same appearance and structure as described above, there was often a problem that, for example, a toner replenishing container storing a magenta toner is mounted on a connection portion connected to a developing kit developing a cyan toner image by mistake, or the like.

In order to solve such a problem, JP-A-2003-84534 discloses an image forming apparatus where incompatible identification devices are provided on toner replenishing containers and toner replenishing container-mounting portions provided on an apparatus body so as to correspond one to one. That is, there is proposed an image forming apparatus where incompatible "shape" or "mounting position" is set on a guide rail guiding a toner replenishing container to a mounting portion.

However, since a guide rail has different shapes or is provided at different positions on the four mounting portions for the toner replenishing containers in JP-A-2003-84534, an assembly process in a factory becomes complicated. In addition, an engagement groove, which is engaged with the guide rail, of the toner replenishing container also needs to have a different shape or be formed at a different position according to the kind of stored toner.

For this reason, since different molding dies are required for the toner replenishing containers corresponding to the kinds of stored toners, not only are costs increased but also space and effort are required for the inventory control of the toner replenishing container, which also causes costs to increase.

SUMMARY

The invention has been made to solve the problem in the related art, and an object of the invention is to provide a toner replenishing container that can be automatically distinguished as, for example, four kinds of toner replenishing containers by a simple structure and an image forming apparatus that is detachably provided with the toner replenishing container.

In order to solve the problem, a toner replenishing container of the invention includes a storage chamber, a hole and an identification member. The storage chamber stores a toner for replenishment. The hole is engaged with the toner replenishing container identifying portion of the mounting portion when the toner replenishing container is mounted on the mounting portion, is formed at a predetermined position on a front surface of the toner replenishing container in a mounting direction, and has a polygonal cross-section. The identification member is detachably inserted into the hole in a form corresponding to the polygonal shape of the hole when an orientation of the identification member is rotated about a center line of the hole.

In order to solve the problem, an image forming apparatus of the invention includes a mounting portion and a toner replenishing container identifying portion. A toner replenishing container is detachably mounted on the mounting portion so that a hole of the toner replenishing container corresponds to a front surface in a mounting direction. The toner replenishing container includes a storage chamber, the hole and an identification member. The storage chamber stores a toner for replenishment. The hole is formed at a predetermined position and has a polygonal cross-section. The identification member is detachably inserted into the hole in a form corresponding to the polygonal shape of the hole when an orientation of the identification member is rotated about a center line of the hole. The toner replenishing container identifying portion is provided on the mounting portion so as to be engaged with the hole when the toner replenishing container is mounted on the mounting portion.

Further, according to the invention, it is possible to obtain an effect of providing a toner replenishing container that can be automatically distinguished as several kinds of toner replenishing containers by a simple structure where one kind of identification member is inserted into each polygonal hole of toner replenishing containers having the same structure, and an image forming apparatus that is detachably provided with the toner replenishing container.

BRIEF DESCRIPTION OF THE DRAWINGS

A more complete understanding of this application can be obtained when the following detailed description is considered in conjunction with the following drawings, in which.

DETAILED DESCRIPTION

Embodiments of the invention will be described in detail below with reference to the drawings.

First Embodiment

Figure 1:
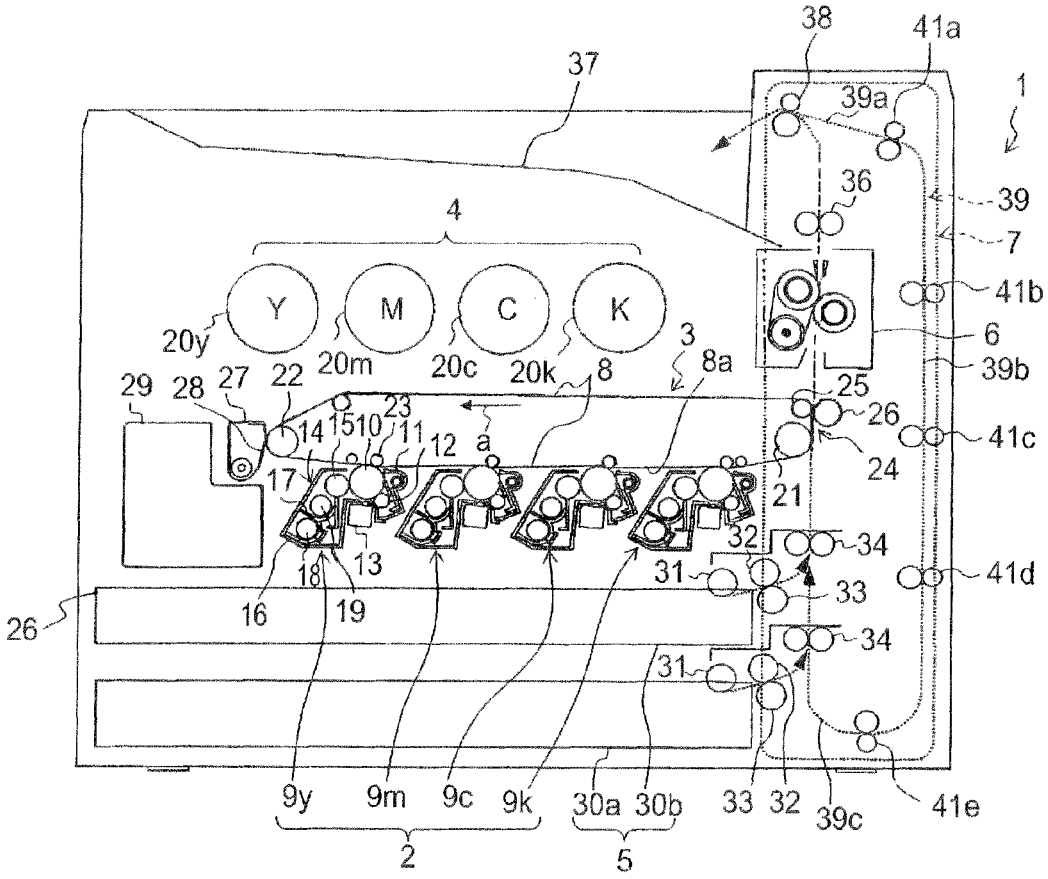
FIG. 1 is a cross-sectional view illustrating the internal structure of a full color image forming apparatus (a printer or an apparatus body) that is provided with toner replenishing containers according to a first embodiment of the invention.

FIG. 1 is a cross-sectional view illustrating the internal structure of a full color image forming apparatus (hereinafter, referred to as a printer or an apparatus body) that is provided with toner replenishing containers according to a first embodiment of the invention.

A printer 1 shown in FIG. 1 is an electrophotographic and secondary transfer tandem-type color image forming apparatus. The printer 1 includes an image forming section 2, a transfer belt unit 3, a toner supply section 4, a sheet feeding section 5, a belt type fixing unit 6, and a conveying unit 7 for duplex printing.

In order to transfer a toner image to a lower traveling portion-surface 8*a* of a transfer belt 8 in a so-called back surface transfer method, the image forming section 2 has a structure where four image forming units 9 (9*k*, 9*c*, 9*m*, and 9*y*) are arranged side by side from the right side to the left side in FIG. 1 in multi-stages so as to come into contact with the lower traveling portion-surface 8*a* of the transfer belt 8.

The image forming section 2 is held by a frame of a body of the printer 1 so as to be capable of moving up and down between a printing position shown in FIG. 1 and a maintenance position below the printing position. Three image forming units 9*y*, 9*m*, and 9*c*, which are provided on the upstream side (the left side in FIG. 1), among the four image forming units 9 form unicolor images that are made of a yellow (y) toner, a magenta (M) toner, and a cyan (C) toner corresponding to the three primary colors of a subtractive color mixture.

Further, the image forming unit 9*k* forms a monochrome image made of a black (K) toner that is mainly used for letters, dark portions of images, or the like. The respective image forming units 9 have the same structure except for the colors of the toners that are used to develop images. Accordingly, the structure of the image forming unit 9*y* for a yellow (y) toner will be described below by way of an example.

The image forming unit 9 is provided with a photoreceptor drum 10 at the uppermost portion thereof. The peripheral surface of the photoreceptor drum 10 is made of, for example, an organic photoconductive material. A cleaner 11, a charging roller 12, an optical writing head 13, and a developing roller 15 of a developing unit 14 are disposed so as to come into contact with or surround the peripheral surface of the photoreceptor drum 10.

The developing unit 14 includes a unit housing 16 that covers the external portion of the developing unit, a partition wall 17 that is provided in the developing unit, a developing roller 15, a first stirring/conveying screw 18, and a second stirring/conveying screw 19. Although not particularly shown, each of the first and second stirring/conveying screws 18 and 19 includes a screw shaft and fins that are formed integrally with the screw shaft and rotate.

As shown by Y, M, C, and K in FIG. 1, one of a yellow (y) toner, a magenta (M) toner, a cyan (C) toner, and a black (K) toner is supplied to the developing unit 14 from one of the toner replenishing containers 20 (20*y*, 20*m*, 20*c*, and 20*k*) of the toner supply section 4.

The transfer belt unit 3 includes the above-mentioned endless transfer belt 8 that extends in the shape of a flat loop in the horizontal direction of FIG. 1 substantially at the center of the apparatus body, and a driving roller 21 and a driven roller 22 on which the transfer belt 8 is stretched and which circularly moves the transfer belt 8 in the counterclockwise direction shown by an arrow a of FIG. 1.

A primary transfer roller 23 is assembled integrally with the unit on the transfer belt 8. The primary transfer roller 23 comes into press contact with the photoreceptor drum 10 with the transfer belt 8 interposed therebetween, and directly transfers a toner image onto the lower traveling portion-surface 8*a* of the transfer belt 8 that is circularly moved on the lower side (primary transfer).

The transfer belt 8 is conveyed to a secondary transfer section 24 that further transfers the toner image onto a sheet (secondary transfer). The secondary transfer section 24 includes a transfer auxiliary roller 25 that is disposed on the downstream side (the upper side in FIG. 1) so as to be adjacent to the driving roller 21, and a secondary transfer roller 26 that comes into press contact with the transfer auxiliary roller 25 with the transfer belt 8 interposed therebetween.

A belt cleaner 27 is disposed on the transfer belt 8. The belt cleaner 27 includes a cleaning blade 28 that comes into contact with the surface of the transfer belt 8 that is stretched by the driven roller 22. Further, a waste toner collecting container 29 is detachably disposed adjacent to the left and lower portions of the belt cleaner 27.

The belt cleaner 27 scrapes and removes waste toner, which remains on the surface of the transfer belt 8 by the cleaning blade 28, and sends the waste toner to the waste toner collecting container 29 by a conveying screw (not shown).

The toner supply section 4 is detachably provided with the four toner replenishing containers 20 (20*y*, 20*m*, 20*c*, and 20*k*) that are disposed above the upper traveling portion of the transfer belt 8. A yellow (y) toner, a magenta (M) toner, a cyan (C) toner, and a black (K) toner are stored in the four toner replenishing containers 20 as described above.

Although hidden on the side facing the transfer belt unit 3 and not shown in FIG. 1, these four toner replenishing containers 20 are connected to the developing units 14 of the corresponding image forming units 9 through toner supply passages continued to toner supply ports of mounting portions.

Although not particularly shown, the toner supply section 4 is held by the frame of the body of the printer 1 with the mounting portions interposed therebetween so as to be capable of moving up and down between a printing position shown in FIG. 1 and a maintenance position above the printing position.

The sheet feeding section 5 includes two sheet feeding cassettes 30 (30*a* and 30*b*) that are disposed in two stages, that is, the upper and lower stages. A sheet ejecting roller 31, a feeding roller 32, a separation roller 33, and a pair of standby conveying rollers 34 are disposed near each of the sheet feeding ports (the right side in FIG. 1) of the two sheet feeding cassettes 30 (30*a* and 30*b*).

The above-mentioned secondary transfer section 24, which includes the transfer belt 8, the transfer auxiliary roller 25, and the secondary transfer roller 26 and transfers the toner image to a sheet, is formed in the sheet conveying direction of the pair of standby conveying rollers 34 (above the pair of standby conveying rollers 34 in the vertical direction of FIG. 1).

The belt type thermal fixing unit 6 is disposed on the downstream side (upper side in FIG. 1) of the secondary transfer section 24; and a pair of discharge rollers 36, which discharge the sheet to which the toner image has been fixed from the belt type thermal fixing unit 6, and a pair of sheet discharge rollers 38, which discharge the discharged sheet to a sheet discharge tray 37 formed on the upper surface of the apparatus, are provided on the downstream side of the belt type thermal fixing unit 6.

The conveying unit 7 for duplex printing also functions as an opening/closing member of which the outer surface (the right outer surface in FIG. 1) opens or shields the inside of the printer 1 to or from the outside from the side surface.

The conveying unit 7 for duplex printing includes a return passage 39 that includes a start return passage 39*a*, an intermediate return passage 39*b*, and an end return passage 39*c*. The start return passage 39*a* diverges from a portion immediately in front of the pair of sheet discharge rollers 38 to the right side in the horizontal direction of FIG. 1. The intermediate return passage 39*b* is bent downward from the start return passage 39*a*. The end return passage 39*c* is bent to the left side opposite to the above side in the horizontal direction, and finally inverts a return sheet.

Further, five pairs of return rollers 41 (41*a*, 41*b*, 41*c*, 41*d*, and 41*e*) are disposed on the return passage 39. An outlet of the end return passage 39*c* is joined to a conveying passage that is directed to the pair of standby conveying rollers 34 corresponding to the lower sheet feeding cassette 30*b* of the sheet feeding section 5.

Figure 2:
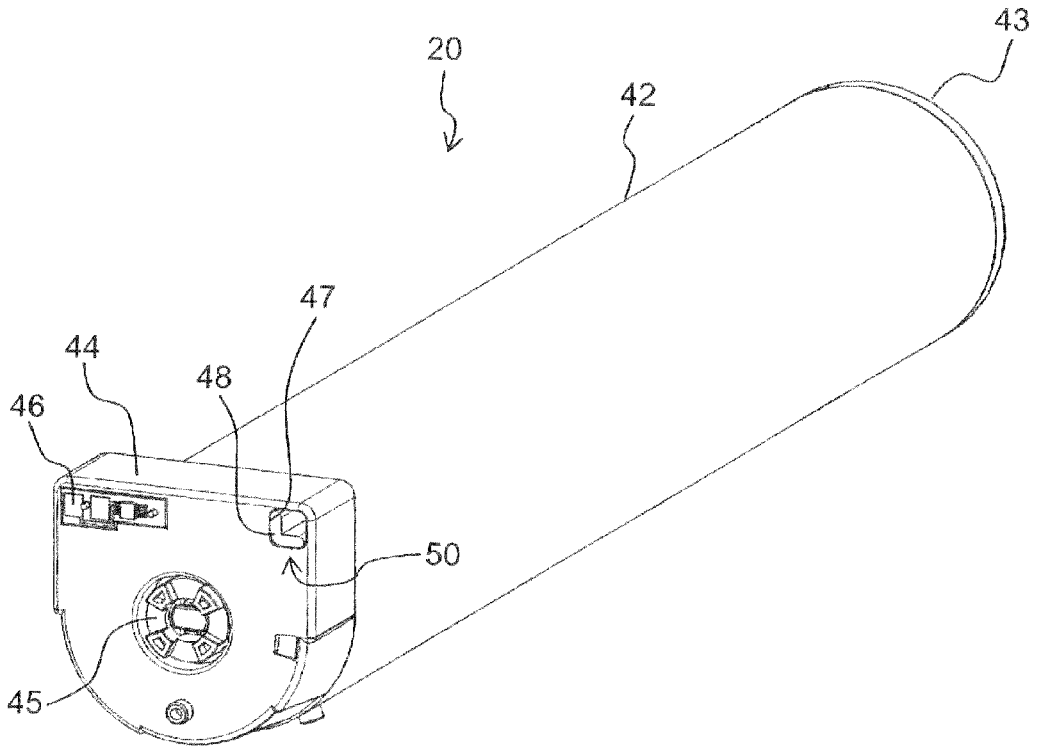
FIG. 2 is a perspective view showing the toner replenishing container alone, according to the first embodiment, which is not yet mounted on a mounting portion of the printer.

FIG. 2 is a perspective view showing the toner replenishing container 20 alone according to the first embodiment that is not yet mounted on the mounting portion of the printer 1. A long cylindrical housing 42 of the toner replenishing container 20 shown in FIG. 2 is filled with one of a yellow (y) toner, a magenta (M) toner, a cyan (C) toner, and a black (K) toner.

One end opening (an upper right end in the oblique direction in FIG. 2) of the housing 42 is covered with a cap 43 so that the inside is sealed from the outside. Further, a shutter cover 44 is fixed to the other end opening (a lower left end in the oblique direction in FIG. 2) of the housing 42 that is to be inserted into the mounting portion when the toner replenishing container 20 is mounted on the mounting portion of the apparatus body 1.

A coupling 45, which stirs the toner stored in the housing 42 and conveys and sends the toner to a toner replenishing passage connected to the mounting portion, is disposed at the center of the front surface of the shutter cover 44. An IC (integrated circuit) board 46, which stores printing information or the like, is mounted on the upper left portion of the front surface of the shutter cover 44.

Furthermore, the upper right corner of the front surface of the shutter cover 44 is a portion that is engaged with a toner replenishing container identifying portion of the mounting portion when the toner replenishing container 20 is mounted on the mounting portion of the apparatus body 1. A quadrangular (square in this embodiment) hole 47 is formed at this position. An L-shaped member 48 is detachably inserted into the hole 47. The hole 47 and the L-shaped member 48 form an identification portion 50 of the toner replenishing container 20.

Figure 3B:
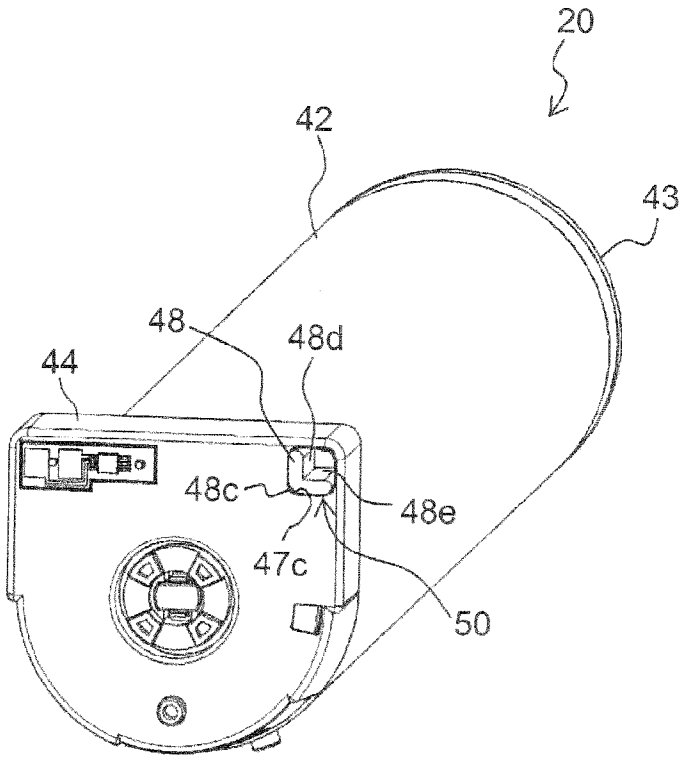
FIGS. 3A and 3B are views illustrating a method of mounting an L-shaped member in a hole of an identification portion of the toner replenishing container according to the first embodiment.
Figure 3A:
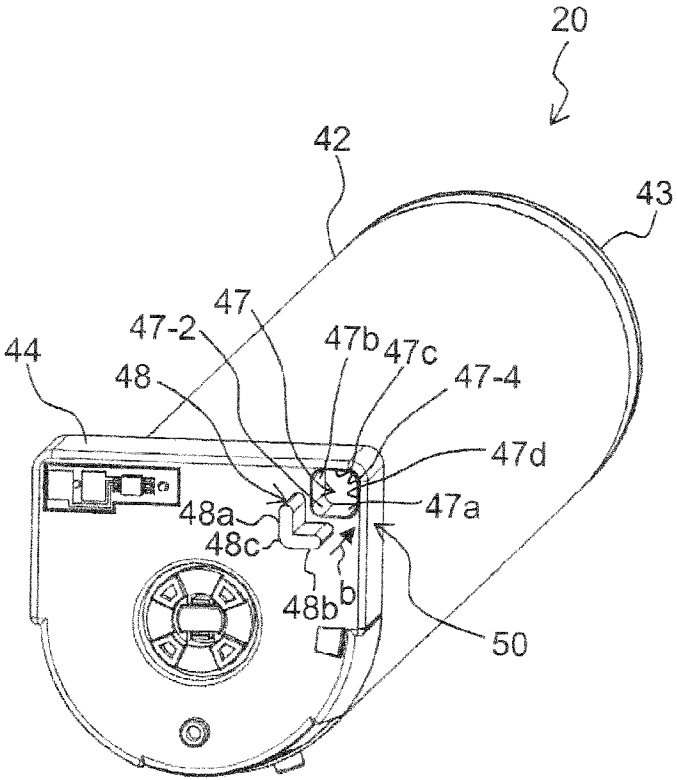

FIGS. 3A and 3B are views illustrating a method of mounting the L-shaped member 48 in the hole 47 of the identification portion 50. Meanwhile, since the angle of sight in FIGS. 3A and 3B is different from that in FIG. 2, the length of the housing 42 in FIGS. 3A and 3B is shown to be smaller than that in the case shown in FIG. 2. However, FIGS. 2, 3A, and 3B show the same toner replenishing container 20.

FIG. 3A shows a state immediately prior to the insertion of the L-shaped member 48 into the hole 47 as shown by an arrow b, and FIG. 3B shows a state where the L-shaped member 48 has been completely inserted into the hole 47.

In FIGS. 3A and 3B, the L-shaped member 48 is disposed so that a horizontal outer surface 48*b* and a vertical outer surface 48*a* forming an L shape come into contact with two adjacent wall surfaces 47*a* and 47*b* of the hole 47 and an L-shaped outer corner portion 48*c* faces a corner portion 47-2 formed by the adjacent two sides (wall surfaces 47*a* and 47*b*) of the hole 47.

Meanwhile, a retaining pin for separation prevention, which prevents the L-shaped member 48 inserted into the hole 47 from being separated from the hole 47, is provided in the hole 47, but is not shown in FIGS. 3A and 3B in order to avoid the complication of FIGS. 3A and 3B.

In the state where the L-shaped member 48 has been completely inserted into the hole 47 shown in FIG. 3B, a space is formed in the hole 47 by vertical and horizontal inner surfaces 48*d* and 48*e* (hereinafter, also see FIG. 3A), which form an L shape, of the L-shaped member 48, a corner portion 47-4 that is diagonal to the corner portion 47-2 of the hole 47 facing the outer corner portion 48*c* of the L-shaped member 48, and two wall surfaces 47*c* and 47*d* provided on both sides of the corner portion 47-4. This space is engaged with a toner replenishing container identifying portion of the mounting portion to be described below.

FIGS. 4A to 4D are views showing the states of the identification portions 50 of the shutter covers 44 when the toner replenishing containers 20*y*, 20*m*, 20*c*, and 20*k* disposed in the toner supply section 4 so as to correspond to the respective image forming units 9*m*, 9*c*, 9*y*, and 9*k* shown in FIG. 1 are mounted on the mounting portions.

In FIGS. 4A to 4D, the L-shaped members 48, which are inserted into the holes 47, of the identification portions 50 of the shutter covers 44 that are engaged with the toner replenishing container identifying portions of the mounting portions to be described below are used as one kind of common part, and are inserted in the quadrangular holes 47 so that the orientation of each L shape is rotated about a center line of each hole 47 by 90 degrees each case.

Figure 4A:
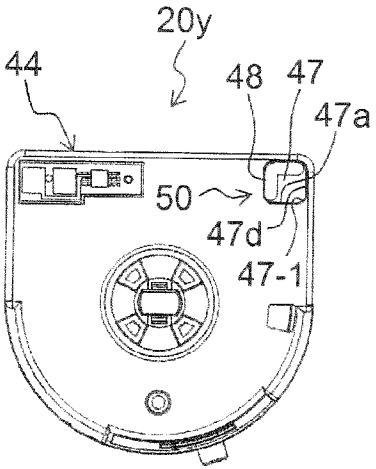
FIGS. 4A to 4D are views showing the state of identification portions of shutter covers when the toner replenishing containers according to the first embodiment are mounted on the mounting portions.

Accordingly, in the toner replenishing container 20*y* shown in FIG. 4A, the space of the hole 47 is formed by being surrounded by the corner portion 47-1, the two wall surfaces 47*a* and 47*d* provided on both sides of the corner portion 47-1, and the vertical and horizontal inner surfaces 48*d* and 48*e* (see FIG. 3B, similarly hereinafter) of the L-shaped member 48.

Figure 4B:
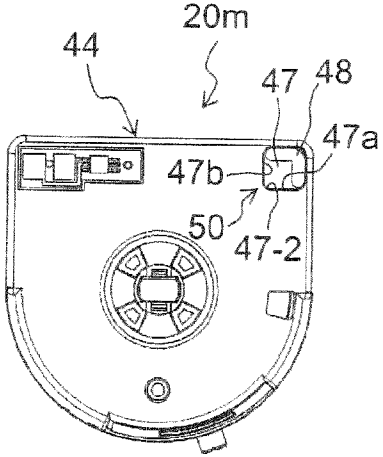

Further, in the toner replenishing container 20*m* shown in FIG. 4B, the space of the hole 47 is formed by being surrounded by the corner portion 47-2, the two wall surfaces 47*a* and 47*b* provided on both sides of the corner portion 47-2, and the vertical and horizontal inner surfaces 48*d* and 48*e* of the L-shaped member 48.

Figure 4C:
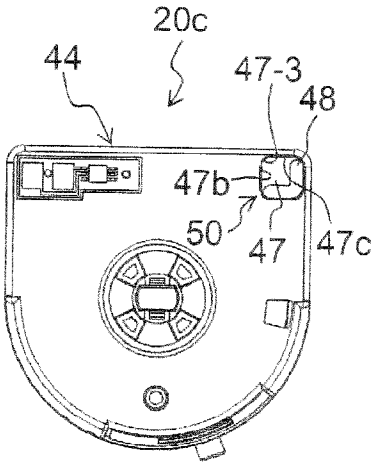

Furthermore, in the toner replenishing container 20*c* shown in FIG. 4C, the space of the hole 47 is formed by being surrounded by a corner portion 47-3, the two wall surfaces 47*b* and 47*c* provided on both sides of the corner portion 47-3, and the vertical and horizontal inner surfaces 48*d* and 48*e* of the L-shaped member 48.

Figure 4D:
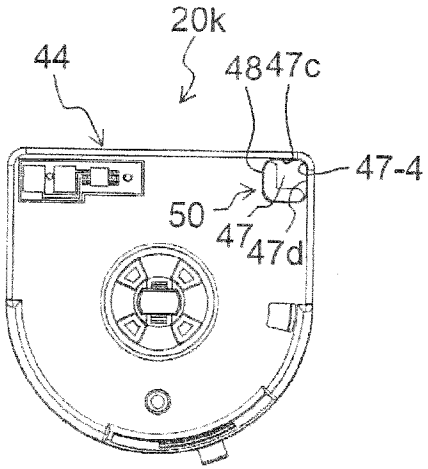

Moreover, in the toner replenishing container 20*k* shown in FIG. 4D, the space of the hole 47 is formed by being surrounded by a corner portion 47-4, the two wall surfaces 47*c* and 47*d* provided on both sides of the corner portion 47-4, and the vertical and horizontal inner surfaces 48*d* and 48*e* of the L-shaped member 48.

That is, which color toner of the four kinds of color toners is to be stored in the toner replenishing container 20 is set according to which corner portion 47-1, 47-2, 47-3, or 47-4 forms the space of the hole 47, that is, the position of the L-shaped member 48 inserted into the hole 47.

Figure 5:
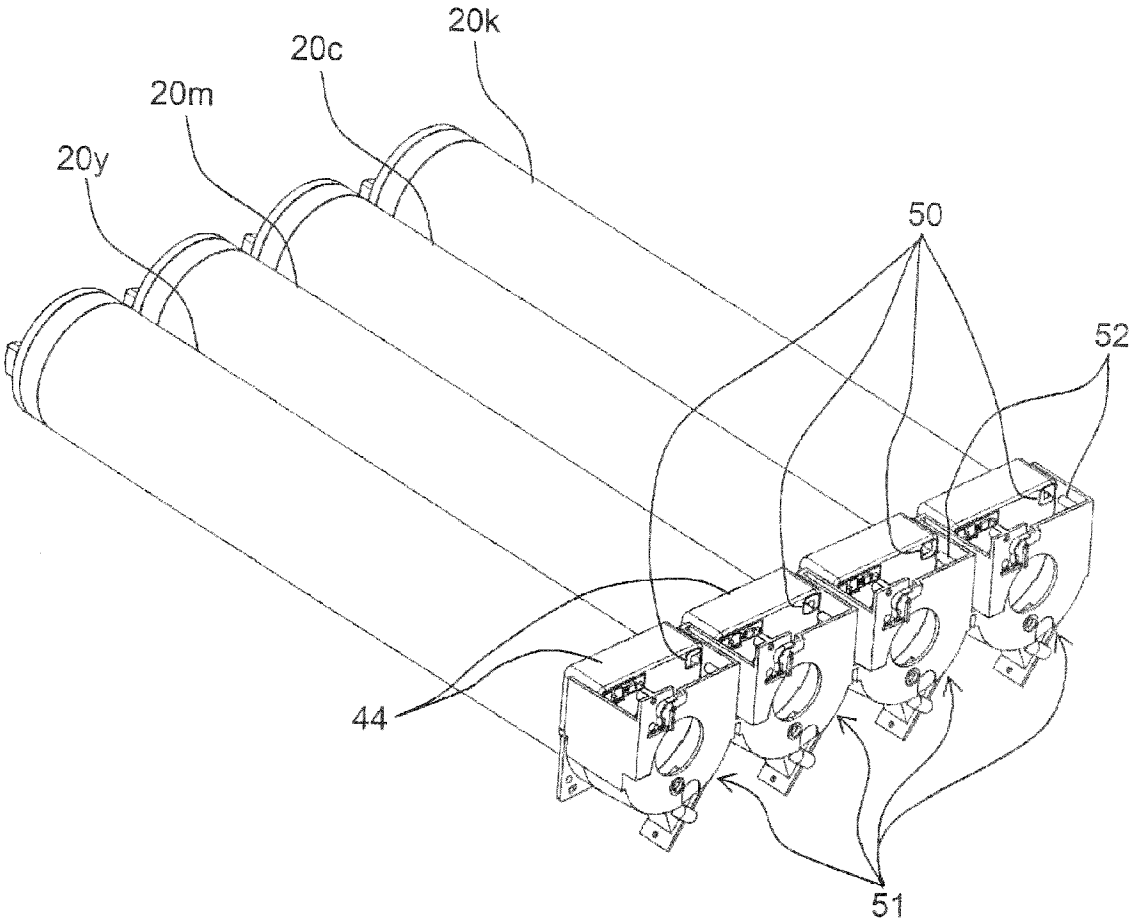
FIG. 5 is a view showing a state where the toner replenishing containers set according to the colors of toner are mounted on toner replenishing container-mounting portions.

FIG. 5 is a view showing a state where the toner replenishing containers 20 of which stored color toners are set as described above are mounted on toner replenishing container-mounting portions of the apparatus body 1. Meanwhile, FIG. 5 shows a state immediately prior to the complete mounting of the toner replenishing containers in order to show a positional relationship between the identification portions 50 of the toner replenishing containers 20 and the toner replenishing container identifying portions of the toner replenishing container-mounting portions.

As shown in FIG. 5, identification pins 52 serving as toner replenishing container identifying portions protrude from the toner replenishing container-mounting portions 51 of the apparatus body 1 at positions, which correspond to the identification portions 50 formed on the mounting surfaces of the shutter covers 44 of the toner replenishing containers 20.

Figure 6:
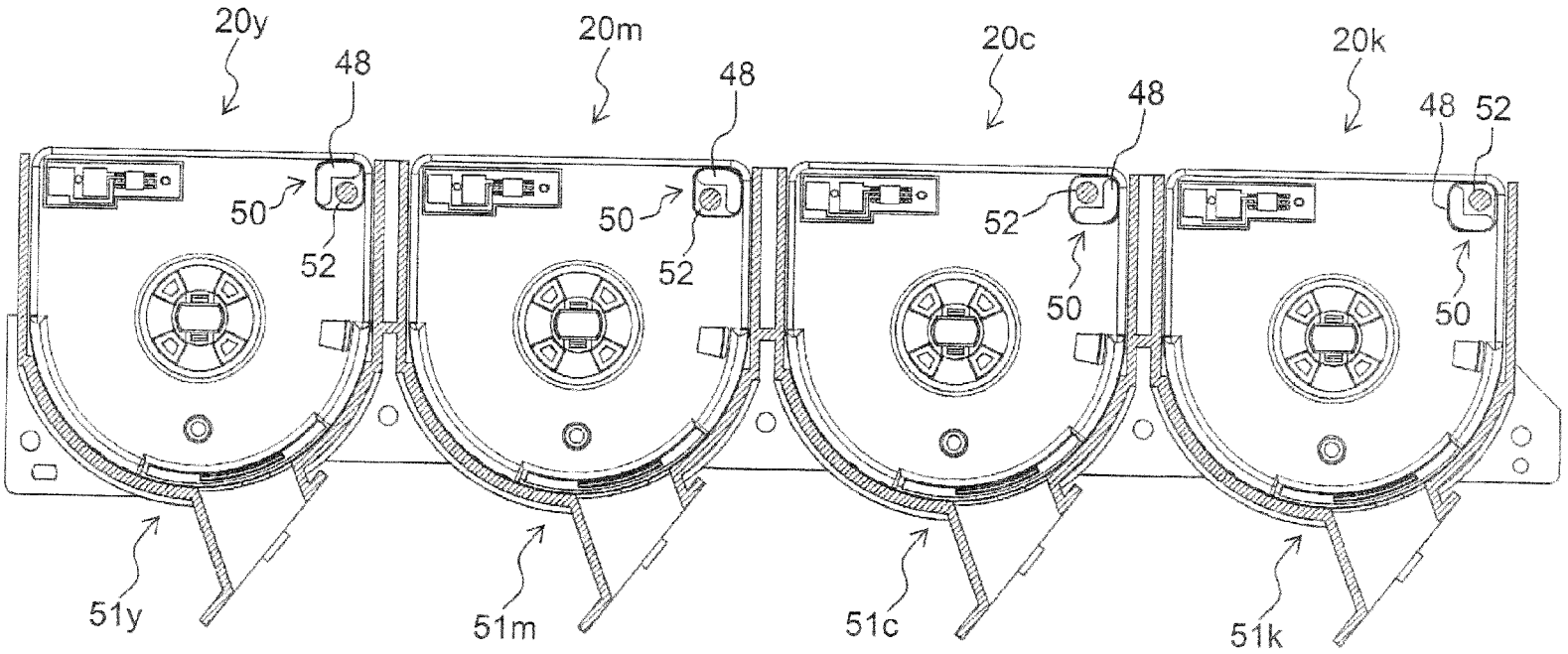
FIG. 6 is a view showing the cross-sections of engagement portions between the identification portions and identification pins when the respective toner replenishing containers are completely mounted on the respective toner replenishing container-mounting portions.

FIG. 6 is a view showing the cross-sections of engagement portions between the identification portions 50 and the identification pins 52 when the respective toner replenishing containers 20 (20*y*, 20*m*, 20*c*, and 20*k*) are completely mounted on the respective toner replenishing container-mounting portions 51 (51*y*, 51*m*, 51*c*, and 51*k*).

Meanwhile, in FIG. 6, only components necessary for description are shown and denoted by the same reference numerals as the reference numerals of the components shown in FIGS. 2 to 5. In FIG. 6, the identification pin 52 corresponding to the toner replenishing container 20*y* is fitted into the space that is surrounded by the corner portion 47-1 of the hole 47, the wall surfaces 47*a* and 47*d*, and the inner surfaces 48*d* and 48*e* of the L-shaped member 48 shown in FIG. 4A.

Further, in FIG. 6, the identification pin 52 corresponding to the toner replenishing container 20*m* is fitted into the space that is surrounded by the corner portion 47-2 of the hole 47, the wall surfaces 47*a* and 47*b*, and the inner surfaces 48*d* and 48*e* of the L-shaped member 48 shown in FIG. 4B.

Furthermore, in FIG. 6, the identification pin 52 corresponding to the toner replenishing container 20*c* is fitted into the space that is surrounded by the corner portion 47-3 of the hole 47, the wall surfaces 47*b* and 47*c*, and the inner surfaces 48*d* and 48*e* of the L-shaped member 48 shown in FIG. 4C.

Moreover, in FIG. 6, the identification pin 52 corresponding to the toner replenishing container 20*k* is fitted into the space that is surrounded by the corner portion 47-4 of the hole 47, the wall surfaces 47*c* and 47*d*, and the inner surfaces 48*d* and 48*e* of the L-shaped member 48 shown in FIG. 4D.

In any case, when the toner replenishing container 20 is mounted on the toner replenishing container-mounting portion 51 that corresponds to the same color as the color of the toner stored in the toner replenishing container 20, there is no problem. When the toner replenishing container 20 is mounted on the toner replenishing container-mounting portion 51 that corresponds to a color different from the color of the toner stored in the toner replenishing container 20, the identification pin 52 collides with the L-shaped member 48. For this reason, the toner replenishing container 20 cannot be mounted on the toner replenishing container-mounting portion 51 that corresponds to a color different from the color of the toner stored in the toner replenishing container 20.

For example, even though the toner replenishing container 20*m* is to be mounted on the toner replenishing container-mounting portion 51*y* of FIG. 6 by mistake, the identification pin 52 collides with the vertical end portion of the inverted L-shaped member 48. For this reason, the toner replenishing container 20*m* cannot be mounted on the toner replenishing container-mounting portion 51*y*.

Moreover, likewise, even though the toner replenishing container 20*c* is to be mounted on the toner replenishing container-mounting portion 51*y* by mistake, the identification pin 52 collides with the corner portion of the L-shaped member 48. For this reason, the toner replenishing container 20*c* cannot be mounted on the toner replenishing container-mounting portion 51*y*.

Further, likewise, even though the toner replenishing container 20*k* is to be mounted on the toner replenishing container-mounting portion 51*y* by mistake, the identification pin 52 collides with the horizontal end portion of the L-shaped member 48. For this reason, the toner replenishing container 20*k* cannot be mounted on the toner replenishing container-mounting portion 51*y*.

Even when the toner replenishing containers 20 are mounted on the other toner replenishing container-mounting portions 51*m*, 51*c*, and 51*k*, the same is applied. Accordingly, the positions of the identification pins 52 protruding from the toner replenishing container-mounting portions 51 uniquely correspond to identification pin fitting spaces that are formed in the holes 47 of the identification portions 50 of the toner replenishing containers 20.

As described above, according to the first embodiment of the invention, not only the shape of the toner replenishing container but also the L-shaped member, which serves an external member, of the identification portion is formed by one kind of member. Accordingly, it is possible to suppress the manufacturing costs of parts and costs for inventory control to a low level, so that the first embodiment is economical.

Figure 7:
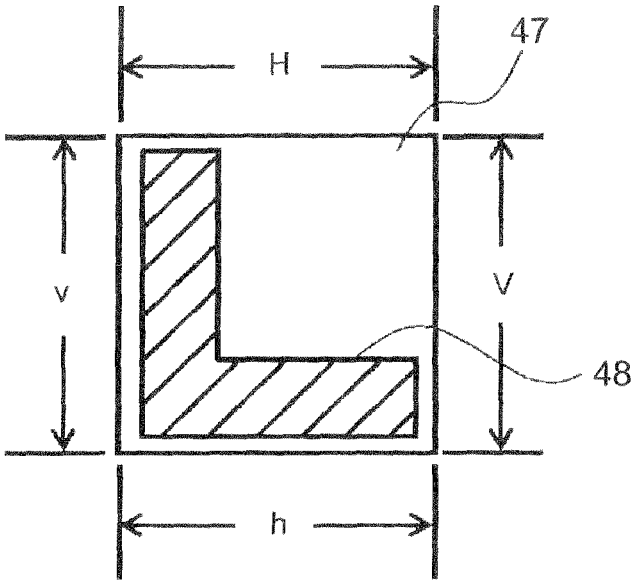
FIG. 7 is a view showing a relationship between the dimensions of a hole of the identification portion and the dimensions of the L-shaped member to be inserted into the hole.

FIG. 7 is a view showing a relationship between the dimensions of the hole 47 of the identification portion 50 and the dimensions of the L-shaped member 48 to be inserted into the hole 47. As shown in FIG. 7, a relationship between the horizontal dimension H and the vertical dimension V of the hole 47 and the horizontal dimension h and the vertical dimension v of the L-shaped member 48 satisfies "H≅h", "H>h", "V≅v", and "V>v".

Since the dimensions of the hole 47 and the dimensions of the L-shaped member 48 to be inserted into the hole 47 are close to each other as described above, the L-shaped member 48 inserted into the hole 47 is not easily separated from the hole 47.

Second Embodiment

FIGS. 8A to 8D are views showing the shapes and setting forms of identification corner setting members that serve as identification members to be inserted into holes 47 of identification portions 50 of toner replenishing containers according to a second embodiment. As shown in FIGS. 8A to 8D, an identification corner setting member 53 is formed of an arc-shaped member corresponding to an angle of 90 degrees.

Since the identification corner setting member 53 of this embodiment is formed in an arc shape, two corners facing each other are empty. However, if a corner inside the arc is used as an identification corner and an identification pin 52 having a large diameter and fitted into a wide space inside the arc is used, a corner outside the arc is not detected as an identification corner since a space outside the arc is narrow.

That is, the identification corner setting member 53 is adapted so as to be fitted into the hole 47 in a form where the identification pin 52 of the toner replenishing container identifying portion can be fitted into only one of the four corners and the identification pin 52 of the toner replenishing container identifying portion cannot be fitted into any of the rest of the corners.

Figure 8A:
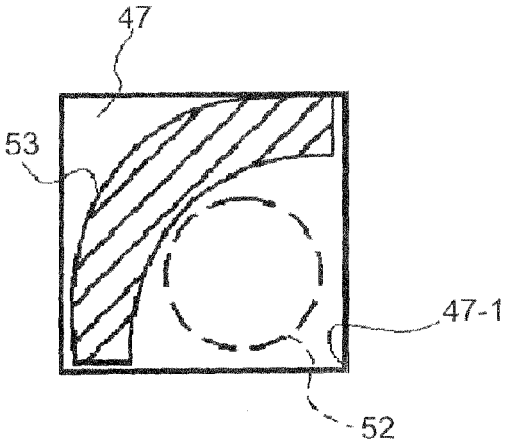
FIGS. 8A to 8D are views showing the shapes and setting forms of identification corner setting members to be inserted into holes of identification portions of toner replenishing containers according to a second embodiment.
Figure 8B:
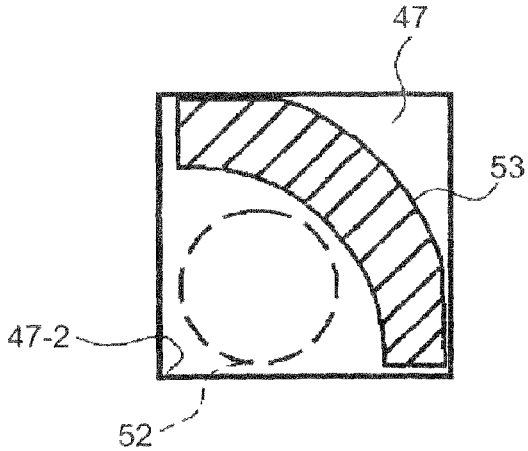
Figure 8C:
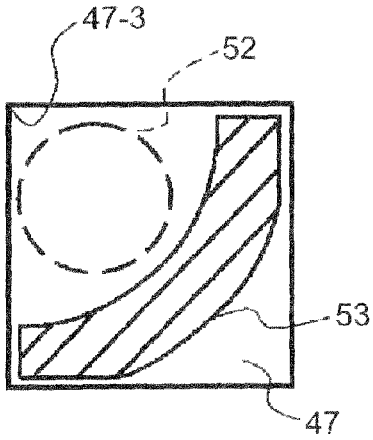
Figure 8D:
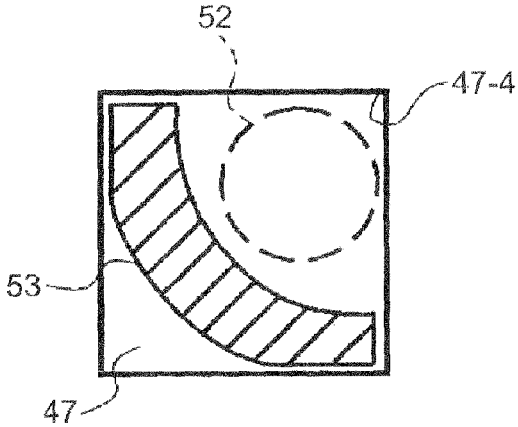

Even in this embodiment, for example, a lower right corner 47-1 of FIG. 8A is set as a corner for the detection of the toner replenishing container 20*y*. Further, a lower left corner 47-2 of FIG. 8B is set as a corner for the detection of the toner replenishing container 20*m*, an upper left corner 47-3 of FIG. 8C is set as a corner for the detection of the toner replenishing container 20*c*, and an upper right corner 47-4 of FIG. 8D is set as a corner for the detection of the toner replenishing container 20*k*.

Third Embodiment

FIGS. 9A to 9D are views showing the shape and setting forms of identification corner setting members 54 to be inserted into holes 47 of identification portions 50 of toner replenishing containers according to a third embodiment. As shown in FIGS. 9A to 9D, the identification corner setting member 54 is formed in a shape that is formed by cutting a side, which faces a corner corresponding to 90 degrees, of a triangle having inside angles of 90 degrees, 45 degrees, and 45 degrees in an arc shape so as to cut 45 degree-corners of both ends.

Due to this shape, the identification corner setting member 54 of this embodiment is formed in the shape that includes a 90 degree-corner portion and two 45 degree-corner cut portions and closes three corners of the hole 47 and leaves only one corner empty. That is, the identification corner setting member 54 of this embodiment is adapted so as to be inserted into the hole 47 in the form where one corner of a quadrangle is empty and all the rest of the corners are closed even though the identification corner setting member 54 is inserted into the hole 47 in any orientation.

Figure 9A:
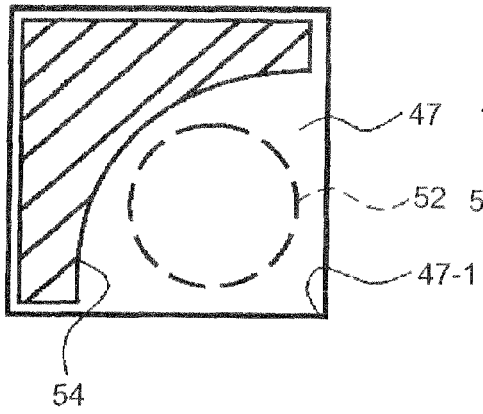
FIGS. 9A to 9D are views showing the shapes and setting forms of identification corner setting members to be inserted into holes of identification portions of toner replenishing containers according to a third embodiment.
Figure 9B:
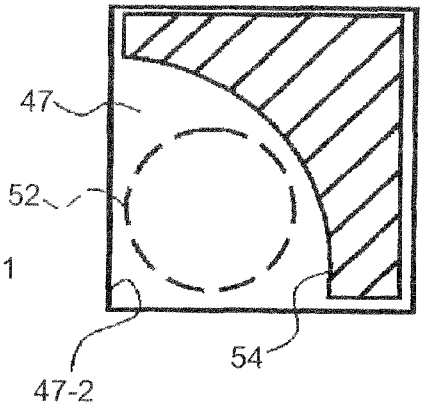
Figure 9C:
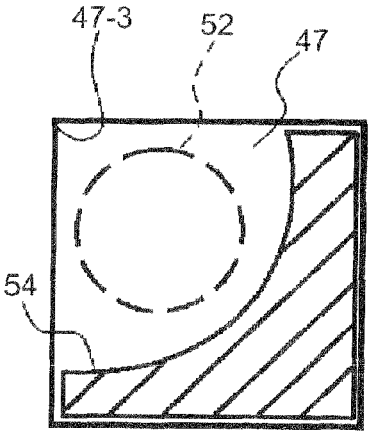
Figure 9D:
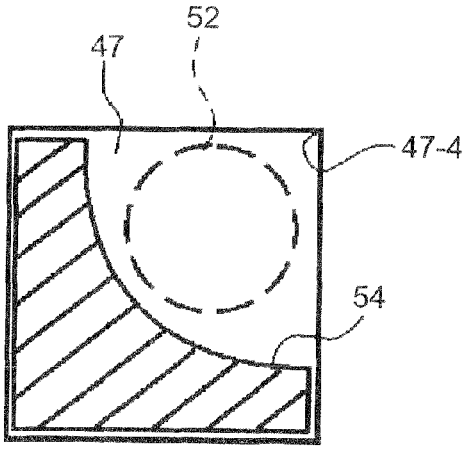

Even in this embodiment, for example, a lower right corner 47-1 of FIG. 9A is set as a corner for the detection of the toner replenishing container 20*y*. Further, a lower left corner 47-2 of FIG. 9B is set as a corner for the detection of the toner replenishing container 20*m*, an upper left corner 47-3 of FIG. 9C is set as a corner for the detection of the toner replenishing container 20*c*, and an upper right corner 47-4 of FIG. 9D is set as a corner for the detection of the toner replenishing container 20*k*.

Fourth Embodiment

FIGS. 10A to 10D are views showing the shapes and setting forms of identification corner setting members 55 to be inserted into holes 47 of identification portions 50 of toner replenishing containers according to a fourth embodiment. As shown in FIGS. 10A to 10D, the identification corner setting member 55 is formed in a fan shape that is opened at an angle of 90 degrees.

Due to this shape, the identification corner setting member 55 of this embodiment is formed in the shape where three corners of the hole 47 are closed by a pivot portion of the fan shape and both open end portions and one corner is empty. That is, the identification corner setting member 55 of this embodiment is adapted so as to be inserted into the hole 47 in the form where one corner of a quadrangle is empty and all the rest of corners are closed even though the identification corner setting member 55 is inserted into the hole 47 in any orientation.

Figure 10A:
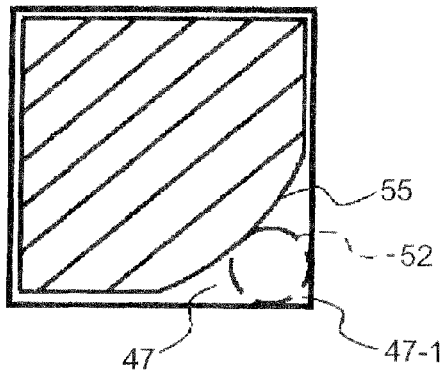
FIGS. 10A to 10D are views showing the shapes and setting forms of identification corner setting members to be inserted into holes of identification portions of toner replenishing containers according to a fourth embodiment.
Figure 10B:
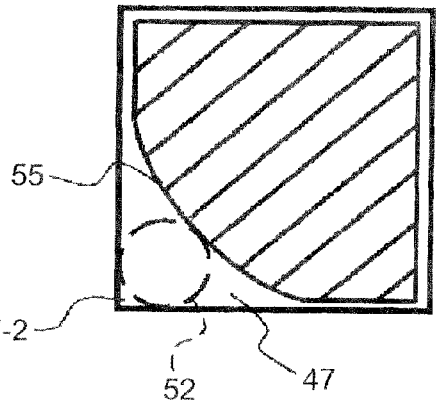
Figure 10C:
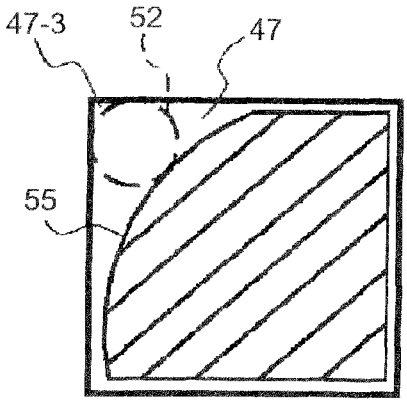
Figure 10D:
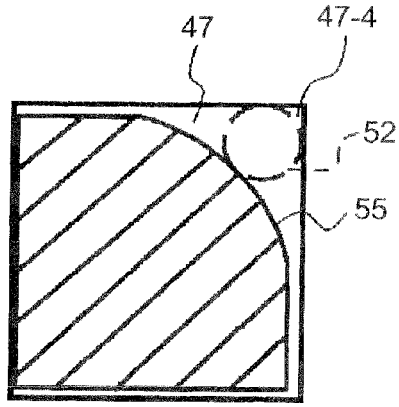

Even in this embodiment, for example, a lower right corner 47-1 of FIG. 10A is set as a corner for the detection of the toner replenishing container 20*y*. Further, a lower left corner 47-2 of FIG. 10B is set as a corner for the detection of the toner replenishing container 20*m*, an upper left corner 47-3 of FIG. 10C is set as a corner for the detection of the toner replenishing container 20*c*, and an upper right corner 47-4 of FIG. 10D is set as a corner for the detection of the toner replenishing container 20*k*.

Meanwhile, in the above-mentioned embodiments, the vertical and horizontal dimensions of the hole 47 are shown to be smaller than the vertical and horizontal dimensions of the identification corner setting member in all cases. However, for example, if a material of the identification corner setting member is hard rubber that is flexible enough for the identification corner setting member to be pushed into the hole 47 and has resistance when the identification pin 52 bumps into the identification corner setting member, the identification corner setting member can be used without difficulty even though the vertical and horizontal dimensions of the identification corner setting member are the same as the vertical and horizontal dimensions of the hole 47.

Further, in the above-mentioned embodiments, the hole 47 has been formed in a quadrangular shape and a total of four kinds of shapes including the shape of the L-shaped member 48 have been shown as the shapes of the identification corner setting member. The shape of the identification corner setting member is not limited thereto, and the hole may have a polygonal shape that has three or more sides.

In short, the shape of the identification corner setting member may be the form where one corner is empty and all of the rest of corners are closed or the form where the identification pin can be fitted into only one corner and cannot be fitted into any of the rest of the corners, even though the identification corner setting member is inserted into the hole in any orientation.

INDUSTRIAL APPLICABILITY

The invention can be used to distinguish the kind of a toner replenishing container replenishing a developing section of an image forming apparatus, which forms a color image, with toner.

Having described and illustrated the principles of this application by reference to one preferred embodiment, it should be apparent that the preferred embodiment may be modified in arrangement and detail without departing from the principles disclosed herein and that it is intended that the application be construed as including all such modifications and variations insofar as they come within the spirit and scope of the subject matter disclosed herein.

The invention claimed is:

1. A toner replenishing container of an image forming apparatus including a mounting portion having a toner replenishing container identifying portion, the toner replenishing container being detachably mounted on the mounting portion, the toner replenishing container comprising:

a storage chamber that stores a toner for replenishment;

a hole that is engaged with the toner replenishing container identifying portion of the mounting portion when the toner replenishing container is mounted on the mounting portion, that is formed at a predetermined position on a front surface of the toner replenishing container in a mounting direction, and that has a polygonal cross-section; and an identification member that is detachably inserted into the hole in a form corresponding to the polygonal shape of the hole when an orientation of the identification member is rotated about a center line of the hole.

2. The toner replenishing container according to claim 1, wherein the identification member is configured to be inserted into the hole so as to form a space at any one corner of the polygonal shape of the hole.

3. The toner replenishing container according to claim 2, wherein the image forming apparatus includes a plurality of mounting portions and the toner replenishing container identifying portions are provided on the plurality of mounting portions in different forms, respectively, and the identification member is configured to be inserted into the hole in a form where the toner replenishing container identifying portion is fitted into only one corner of the polygonal shape and where the toner replenishing container identifying portion is not fitted into the other corners.

4. The toner replenishing container according to claim 3, further comprising:

four kinds of toner replenishing containers in which toners for replenishment stored in the storage chambers are different, wherein the identification member is configured to identify which kind of toner is stored by setting a position of the corner of the hole, into which the toner replenishing container identifying portion is fitted, according to a position of the identification member fitted into the hole.

5. The toner replenishing container according to claim 4, wherein the four different kinds of toner replenishing containers correspond to four kinds of different colors of the toners for replenishment, and the identification member is configured so as to set which color toner of the four kinds of color toners is to be stored, according to the position of the identification member fitted into the hole.

6. The toner replenishing container according to claim 5, wherein the toner replenishing container identifying portion includes a pin standing on the mounting portion.

7. The toner replenishing container according to claim 1, wherein the polygonal shape is a quadrangular shape, and the identification member is formed of an L-shaped member of which vertical and horizontal outer surfaces forming an L shape come into contact with two adjacent wall surfaces of the hole and which is detachably inserted into the hole.

8. The toner replenishing container according to claim 7, wherein the toner replenishing container identifying portion of the mounting portion is engaged with a space that is formed by (i) vertical and horizontal inner surfaces of the L shape of the L-shaped member, (ii) a corner portion diagonal to a corner of the hole facing an outer corner of the L-shaped member, and (iii) two wall surfaces provided on both sides of the corner portion.

9. The toner replenishing container according to claim 8, wherein the toner replenishing container identifying portion includes a pin standing on the mounting portion.

10. An image forming apparatus comprising:

a mounting portion on which a toner replenishing container is detachably mounted so that a hole of the toner replenishing container corresponds to a front surface in a mounting direction, wherein the toner replenishing container includes:

a storage chamber that stores a toner for replenishment, the hole that is formed at a predetermined position and that has a polygonal cross-section, and an identification member that is detachably inserted into the hole in a form corresponding to the polygonal shape of the hole when an orientation of the identification member is rotated about a center line of the hole; and a toner replenishing container identifying portion that is provided on the mounting portion so as to be engaged with the hole when the toner replenishing container is mounted on the mounting portion.

11. The image forming apparatus according to claim 10, wherein the identification member is configured to be inserted into the hole so as to form a space at any one corner of the polygonal shape of the hole.

12. The image forming apparatus according to claim 11, wherein a plurality of the mounting portions are provided and the toner replenishing container identifying portions are provided on the plurality of mounting portions in different forms, respectively, and the identification member is configured to be inserted into the hole in a form where the toner replenishing container identifying portion is fitted into only one corner of the polygonal shape and where the toner replenishing container identifying portion is not fitted into the other corners.

13. The image forming apparatus according to claim 12, further comprising:

four kinds of toner replenishing containers in which toners for replenishment stored in the storage chambers are different, wherein the identification member is configured to identify which kind of toner is stored by setting a position of the corner of the hole, into which the toner replenishing container identifying portion is fitted, according to a position of the identification member fitted into the hole.

14. The image forming apparatus according to claim 13, wherein the four different kinds of toner replenishing containers correspond to four kinds of different colors of the toners for replenishment, and the identification member is configured so as to set which color toner of the four kinds of color toners is to be stored, according to the position of the identification member fitted into the hole.

15. The image forming apparatus according to claim 14, wherein the toner replenishing container identifying portion includes a pin standing on the mounting portion.

16. The image forming apparatus according to claim 10, wherein the polygonal shape is a quadrangular shape, and the identification member is formed of an L-shaped member of which vertical and horizontal outer surfaces forming an L shape come into contact with two adjacent wall surfaces of the hole and which is detachably inserted into the hole.

17. The image forming apparatus according to claim 16, wherein the toner replenishing container identifying portion of the mounting portion is engaged with a space that is formed by (i) vertical and horizontal inner surfaces of the L shape of the L-shaped member, (ii) a corner portion diagonal to a corner of the hole facing an outer corner of the L-shaped member, and (iii) two wall surfaces provided on both sides of the corner portion.

18. The image forming apparatus according to claim 17, wherein the toner replenishing container identifying portion includes a pin standing on the mounting portion.

* * * * *